US005690565A

United States Patent [19]

Swanson

[11] Patent Number: 5,690,565

[45] Date of Patent: Nov. 25, 1997

[54] RECREATIONAL GAME APPARATUS WITH INDICATOR

[76] Inventor: Leonard A. Swanson, 410 Mors, Wheeling, Ill. 60090

[21] Appl. No.: 602,587

[22] Filed: Feb. 16, 1996

[51] Int. Cl.[6] ..... A63B 67/00

[52] U.S. Cl. ..... 473/417; 273/371; 473/420

[58] Field of Search ..... 273/371, 374, 273/393, 238, 341; 473/417, 419, 420

[56] References Cited

U.S. PATENT DOCUMENTS 1,247,733 11/1917 Simpson ..... 273/393 X 2,993,696 7/1961 Demaline ..... 273/341.1

4,848,767 7/1989 Correro ..... 273/238 X 4,981,300 1/1991 Winkler ..... 273/238

*Primary Examiner*—William H. Grieb

*Attorney, Agent, or Firm*—Edward D. Gilhooly, Ltd.

[57] ABSTRACT

A game apparatus having a plurality of game pieces to be pulled, kicked or struck for removal from a base. The base includes a sound emitting circuit to indicate removal of the game piece from the base.

7 Claims, 2 Drawing Sheets

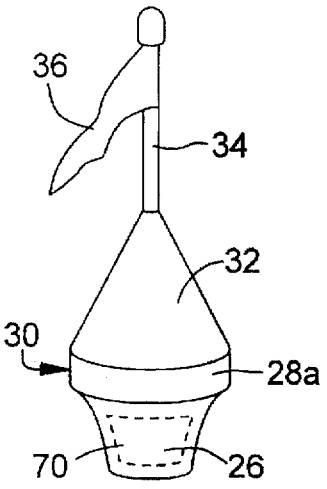
FIG. 1
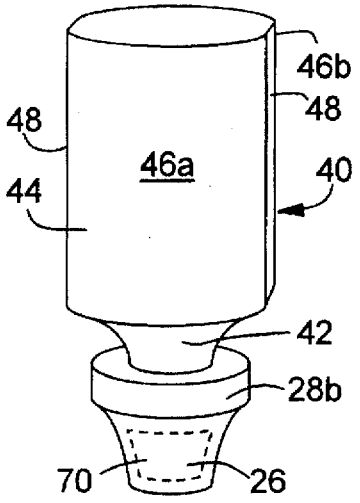
FIG. 3
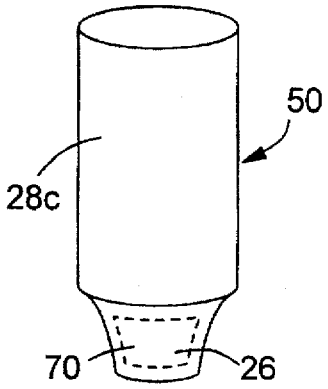
FIG. 4
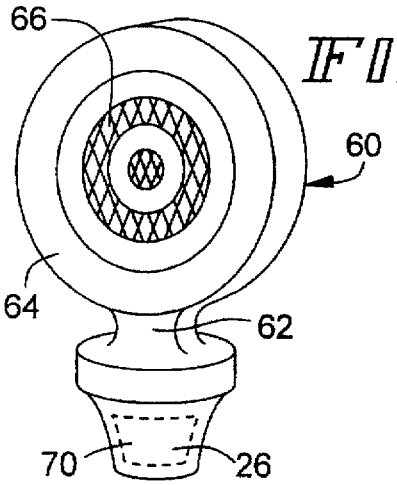
FIG. 5
FIG. 2
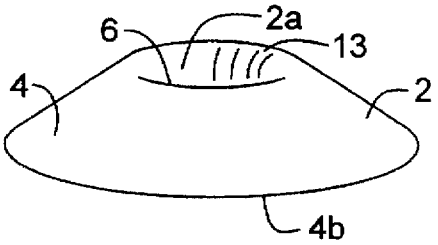
FIG. 6
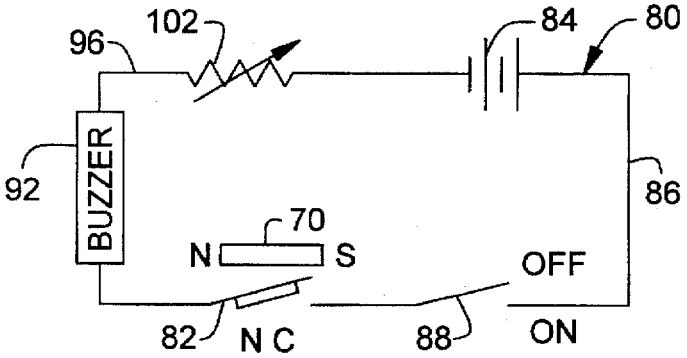

RECREATIONAL GAME APPARATUS WITH INDICATOR

BACKGROUND OF THE INVENTION

1. Field of the Invention

This invention relates to recreational games and more specifically, to a game apparatus having pieces to be pulled, struck or kicked.

2. Summary of the Prior Art

Several well known old games have been played in the past in which articles or pieces are kicked, pulled, struck or otherwise dislodged from a fixed position. Some of these games have been traditionally referred to by many names, such as, for example, "Kick the Can", "Steal the Bacon", "Capture the Flag" and other expressions. In the past, such games were played with many different techniques and equipment. None of the known games however, are capable of being used for a plurality of different games with aesthetically attractive equipment and the capability of making audio or visual signals during play. Thus, it is desirable to provide an improved game apparatus capable of being used for a variety of recreational games.

SUMMARY OF THE INVENTION

It is an objective of the invention to provide an improved game apparatus having a sensory indicator and being capable of being used for a wide range of recreational activities. The apparatus of the invention includes a unique base in which the bottom portion of specifically designed game pieces are inserted for removable support. Each game piece is designed for a specific kind of game or games to be played. The base herein described is provided with circuit means to emit a signal, such as a sound upon removal of the game piece. Dependent on the game being played, the participant kicks or pulls the game pieces from the base, or strikes the game piece from position by another object, such as by a ball, stick and the like.

BRIEF DESCRIPTION OF THE DRAWINGS

FIG. 1 is a front perspective view of a first embodiment of a game piece of the invention;

FIG. 2 is a front perspective view of the game piece receiving base of the invention;

FIG. 3 is a front perspective view of a second embodiment of a game piece of the invention;

FIG. 4 is a front perspective view of a third embodiment of a piece of the invention;

FIG. 5 is a front perspective view of a fourth embodiment of a game piece of the invention;

FIG. 6 is a schematic view of the indicator circuit in the base of FIG. 2;

DESCRIPTION OF THE PREFERRED EMBODIMENTS

Figure 7:
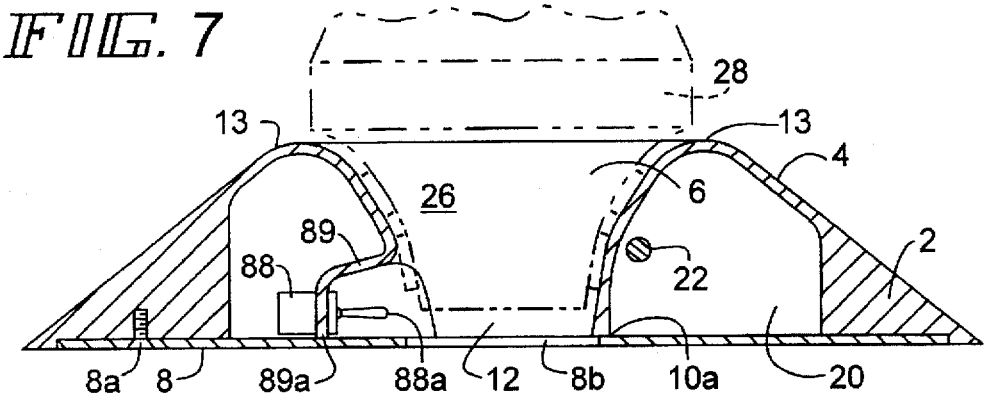
FIG. 7 is a side elevational view, with parts in section, of the base of FIG. 2.
Figure 8:
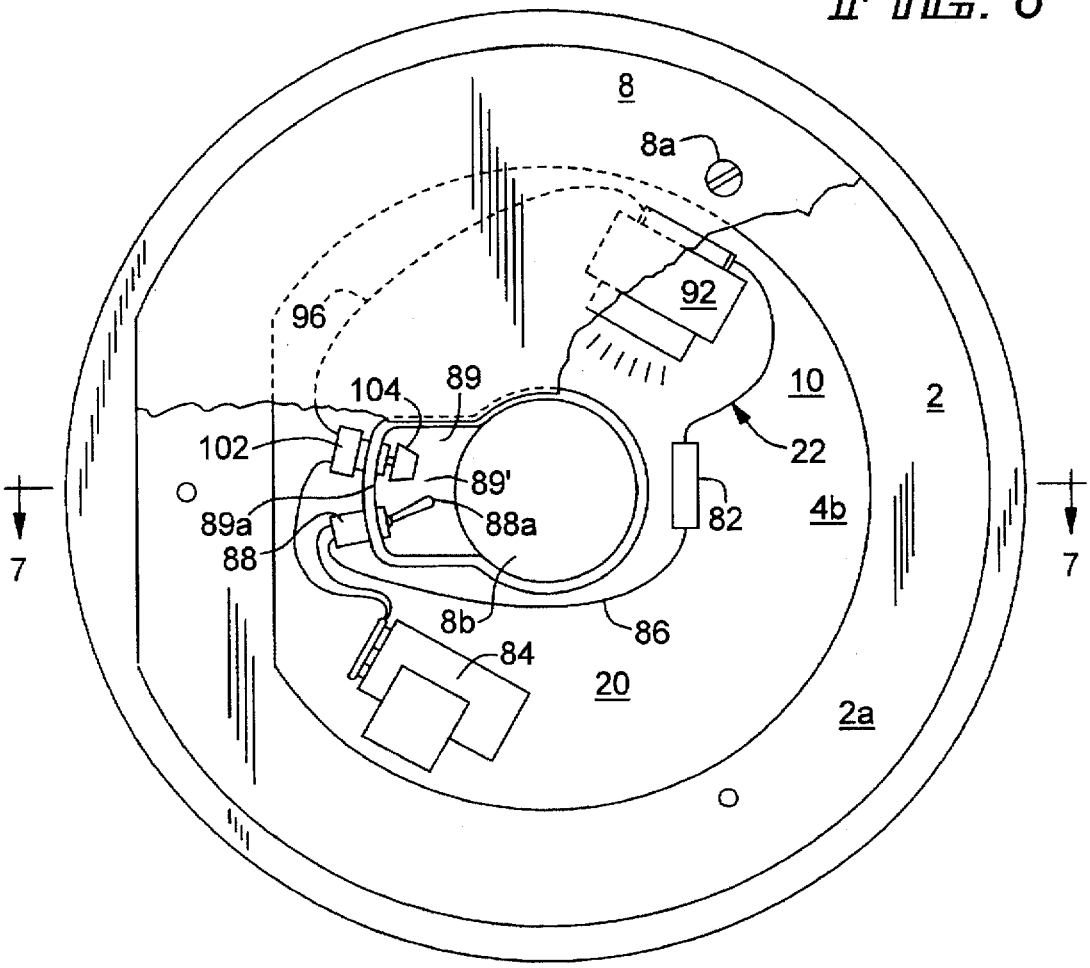
FIG. 8 is a bottom plan view, with parts in section, of the base of FIG. 2.

Referring to FIG. 2, 7, and 8, there is illustrated the base 2 of the invention. The base 2 is arranged to be supported on the ground, gymnasium floor, blacktop, or any other surface on which the participants are playing. The base 2 may be fabricated from a plastic, ceramic, or a metal, as desired. In FIG. 2, it is shown that base 2 includes a body 2*a* forming a continuous, truncated cone 4 and an upper game piece receiving opening 6. A flat bottom plate 8 is removably affixed to an open bottom 4*b* of base 2 for stable support on a supporting surface. The bottom plate 8 is formed with a central switch access opening 8*b*.

As seen in FIG. 7, an outwardly curved, generally continuous circular wall 10 forms a central internal passage 12 from opening 6 for receiving the game piece. The internal wall 10 is integrally joined to a upper curved wall portion 13 forming the apex of base 2. The internal wall 10 with curved upper wall 13 encloses a cavity 20 formed within the body 2*a* of base 2. The bottom plate 8 may be removed to provide access to the cavity 20 and when in place to protect the sound circuit 22 mounted in cavity 20 from moisture and contaminants. The curvature of the internal wall 10 is selected to diverge outward in an upward direction to correspond to the shape of inserted portion 26 of a game piece of the embodiments of the invention to be described which are inserted into passage 12 through opening 6. In the inserted position, the game piece is carried in an upright position, but is able to be smoothly dislodged from position by being kicked, pulled or struck.

As seen in FIGS. 1, 3, 4, and 5, each of the game pieces flare outward from the inserted portion 26 to form respectively a cylindrical portion 28 as will be apparent, though specific game pieces are described herein, it is within the scope of the invention to use other designs for particular games, if desired. In FIG. 1, a game piece 30 is shown having a cylindrical portion 28*a* and upper conical top 32 on which a flag pole 34 and a flag 36 are disposed. The game piece 30 is particularly desirable for use in the game "Capture the Flag", in which participants pull the flag or other desired games.

In FIG. 3, another embodiment of the game piece of the invention is shown, generally designated by reference numeral 40. The game piece 40 has a narrowed neck portion 42 extending upward from cylindrical portion 28*b*. The neck portion 42 integrally supports a solid upper body 44 having curved front and back surfaces 46*a*, 46*b* and relatively narrow flat sides 48. Game piece 40 can be played in a game called "Steal the Bacon" or other games.

In FIG. 4 the game piece 50 has a continuous cylindrical upper portion 28*c* extending upward from inserted portion 26, Game piece 50 may be used to play "Kick the Can" or a similar game.

In FIG. 5, the game piece 60 includes a narrowed neck portion 62 and an upper disc-shaped upper body 64 having indicia 66. The game piece 60 may be used to play the game "Hit Me" by being struck by a ball and the like, or be used in other games.

Each of the game pieces 30, 40, 50 and 60, as shown in FIGS. 1, 3, 4, and 5, include one or more magnets 70 embedded within inserted portion 26. In FIGS. 6–8, the sound-producing circuit 80 of the invention is illustrated. The circuit 80 is mounted within cavity 20 of base 2. The circuit 80 includes a conventional reed switch 82 which is open in the presence of the magnet 70 when a game piece is present in base 2. The switch 82 is connected to a battery 84 of suitable voltage by electrical conductor 86. An on-off switch is connected to electrical conductor 86 to activate and deactivate the circuit 80. The switch 88 includes an on-off lever 88*a* and is mounted on a partial cup-shaped wall portion 89 integrally formed at the bottom of wall 10 and having an open bottom 89 adjacent to bottom plate 8. The bottom edge 89*a* of wall portion 89 as well as the bottom edge 10*a* of wall 10 seal with the bottom plate 8. The switch lever 88*a* is accessible through opening 8*a* of bottom plate 8. When a game piece as previous described is removed or dislodged from base 2, the reed switch 82 is closed to activate buzzer device 92, if the circuit 80 is activated by switch 88. The battery 84 is connected to the buzzer 92 by electrical conductor 96. A conventional variable volume control 102 is present in electrical conductor 96 and controls the volume of buzzer 92. Control of the volume, control 92 is externally provided by knob 104 which is also located within the cup-shaped wall portion 89. The wall 10 of base 2 may include a plurality of holes (not shown) to better emit the indicating sound from buzzer 92.

What is claimed is:

1. A game apparatus comprising having a flat bottom and upper body;

said upper body including a vertical internal passage extending substantially from said flat bottom and having an upper opening for receiving the lower end of a game piece, said lower end having an inserted length extending into a substantial portion vertically of said internal passage for support in an upright orientation said internal passage having a gradually increasing width from adjacent said bottom plate to said upper opening, said lower end having a configuration substantially corresponding to the configuration of the internal passage, and said configuration being shaped to permit said game piece to be dislodged from said passage said passage is formed by a circumferentially extending wall having a curved configuration, said lower end of said game piece includes a circumferentially extending curved wall generally corresponding to said circumferentially extending wall of said base for creating substantial circumferential contact along the inserted length of said lower end between said circumferentially extending curved wall and said circumferentially extending curved lower end of said game piece.

2. The game apparatus according to claim 1 wherein said upper body is generally formed as a truncated cone.

3. The game apparatus of claim 1 further including circuit means positioned within said base, said circuit means including an indicator means indicating the removal of a game piece from said base, said upper body having an internal cavity, said flat bottom acting to seal said internal cavity, and said circuit means being positioned in said internal cavity.

4. The game apparatus of claim 3 wherein said indicator emits sound to indicate removal of a game piece from said base.

5. The game apparatus according to claim 3 wherein said circuit means includes a reed switch, said lower end of said game piece having a magnet for opening said reed switch, said magnet acting to close said reed switch upon removal of said game piece and cause sound to be emitted by said indicator device.

6. The game apparatus of claim 3 wherein said bottom plate having an opening said circuit means includes an on-off switch having an actuator within said lower body, said actuator being externally accessible through said opening.

7. The game apparatus of claim 6 wherein said circuit means includes volume control means having an volume control actuator positioned in said lower body and being externally accessible through said opening.

* * * * *